US005085959A

United States Patent [19]

Kazuyuk

[11] Patent Number: 5,085,959

[45] Date of Patent: * Feb. 4, 1992

[54] SE OR SE ALLOY ELECTROPHOTOGRAPHIC PHOTORECEPTOR

[75] Inventor: Urabe Kazuyuk, Kawasaki, Japan

[73] Assignee: Fuji Electric Co., Ltd., Japan

[ * ] Notice: The portion of the term of this patent subsequent to Feb. 5, 2008 has been disclaimed.

[21] Appl. No.: 391,475

[22] Filed: Aug. 9, 1989

[30] Foreign Application Priority Data

Aug. 11, 1988 [JP] Japan ..... 63-200884

[51] Int. Cl.[5] ..... G03G 5/047; G03G 5/09

[52] U.S. Cl. ..... 430/58; 430/95

[58] Field of Search ..... 430/57, 58, 63, 95

[56] References Cited

U.S. PATENT DOCUMENTS

| | | | |
|---|---|---|---|
| 3,393,070 | 7/1968 | Snelling | 430/63 X |
| 3,639,120 | 2/1972 | Snelling | 430/57 |
| 3,901,703 | 8/1975 | Baum | 430/63 X |
| 4,296,191 | 10/1981 | Jacobson et al. | 430/57 |
| 4,379,820 | 4/1983 | Nakamura et al. | 430/58 |
| 4,554,230 | 11/1985 | Foley et al. | 430/58 |
| 4,868,099 | 9/1989 | Narita | 430/58 |
| 4,990,420 | 2/1991 | Urabe | 430/58 |

FOREIGN PATENT DOCUMENTS

| | | | |
|---|---|---|---|
| 0135370 | 3/1985 | European Pat. Off. | 430/57 |
| 2437268 | 2/1976 | Fed. Rep. of Germany | 430/95 |
| 57-45551 | 3/1982 | Japan | 430/95 |
| 60-84545 | 5/1985 | Japan | 430/58 |
| 60-252357 | 12/1985 | Japan | 430/95 |
| 63-48558 | 3/1988 | Japan | 430/57 |

*Primary Examiner*—Roland Martin

*Attorney, Agent, or Firm*—Brumbaugh, Graves, Donohue & Raymond

[57] ABSTRACT

An electrophotographic photoreceptor having a good printing quality can be provided by a photoreceptor comprising a charge transporation layer composed of a photosensitive material containing a hole mobility enhancing material. Thus, in accordance with an emboidment of the invention, it is possible to rapidly attenuate negative charge and to obtain a photoreceptor having a good printing quality by adding a hole mobility enhancing material to the CTL without producing a difference in print density between regions of the photoreceptor between sheets of paper and covered with a sheet. Some metal oxides and acids, such as $WO_2$, $WO_3$, $MnO_4$, $H_3PO_3$, $H_2SO_3$ and $HAsO_2$, are found to have a hole mobility enhancing effect to a CTL of a selenium alloy. Some metal elements, such as Sn, Co, Pb, Fe, Cu, Hg, Ag and Ce, are also found to have a hole mobility enhancing effect to the CTL. Finally, halogen elements are also found to have a hole mobility enhancing effect to the CTL.

8 Claims, 3 Drawing Sheets

SE OR SE ALLOY ELECTROPHOTOGRAPHIC PHOTORECEPTOR

BACKGROUND OF THE INVENTION

The present invention relates to an electrophotographic photoreceptor comprising a charge transportation layer composed of a photosensitive material containing a hole mobility material.

An electrophotographic photoreceptor (hereinunder referred to as "photoreceptor") is composed of a conductive substrate of, for example, an aluminum alloy and a photosensitive layer composed of a photoconductive material such as amorphous selenium provided on the conductive substrate. When such a photoreceptor is used for a printer a reverse development system is generally adopted in which positive corona discharge is used for charging and negative corona discharge is used for transfer.

In this system, the photosensitive layer is first positively charged by corona discharge in the dark. A laser beam is then projected onto the surface of the photosensitive layer in correspondence with the image, whereby the potential of the exposed portion attenuates so as to become a highlight potential while the portion which is not exposed to the laser beam retains the positive charge, thereby having a shadow potential and forming an electrical image, namely, an electrostatic latent image. Thereafter, in the developing portion, positively charged toner is adhered to the highlight potential regions having a low potential. This toner is transferred to paper by applying a negative corona discharge to the back surface of the paper so that the toner thermally and chemically fixed. The toner remaining on the surface of the photosensitive layer without being transferred to the paper is removed with a fur brush and a blade in the cleaning process, and the remaining charges are removed by light or AC static elimination, before proceeding to the next cycle.

At the perforation of a continuous form or between cut sheets, the photoreceptor is directly exposed to the negative corona discharge during transfer, thereby causing negative charge on the photoreceptor. If this negative charge is large, it is difficult to apply a potential for positive charge in the next cycle and the highlight potential and the shadow potential lower, so that a difference in printing density is produced between the photoreceptor between sheets and the photoreceptor covered with a sheet and exerts a deleterious influence on the printing quality.

This negative charge produced by negative corona discharge during transfer is particularly difficult to attenuate on a photosensitive layer of an amorphous selenium material because the mobility of electrons is low therein. From this fact, it is considered that negative charge is attenuated by the mechanism of injecting holes from the substrate, which move to the surface by the action of an electric field, thereby cancelling the negative charges on the surface.

Negative charging can also be a problem in a photoreceptor having a single photosensitive layer or a function separation type photoreceptor consisting of a charge transportation layer (hereinunder referred to as "CTL") on the substrate side and a charge generation layer (hereinunder referred to as "CGL"). The main causes of the negative charging are considered to be:

(1) the degradation of the hole injection by the presence of mainly, an insulating oxide film in the interface between the substrate and the photosensitive layer or the CTL, and (2) the low hole mobility in the CTL.

Accordingly, it is an object of the present invention to enhance the hole mobility in the CTL so as to solve the above-described problem (2) and to provide an electrophotographic photoreceptor having good characteristics with respect to negative charge.

SUMMARY OF THE INVENTION

It has now been discovered that an electrophotographic photoreceptor having a good printing quality can be provided by a photoreceptor comprising a charge transportation layer composed of a photosensitive material containing a hole mobility enhancing material. Thus, in accordance with an embodiment of the invention, it is possible to rapidly attenuate negative charge and to obtain a photoreceptor having a good printing quality by adding a hole mobility enhancing material to the CTL without producing a difference in print density between regions of the photoreceptor between sheets of paper and covered with a sheet. Some metal oxides and acids, such as $WO_2$, $WO_3$, $MnO_4$, $H_3PO_3$, $H_2SO_3$ and $HAsO_2$, are found to have a hole mobility enhancing effect to a CTL of a selenium alloy. Some metal elements, such as Sn, Co, Pb, Fe, Cu, Hg, Ag and Ce, are also found to have a hole mobility enhancing effect to the CTL. Finally, halogen elements are also found to have a hole mobility enhancing effect to the CTL.

DETAILED DESCRIPTION OF THE INVENTION

Figure 1A:
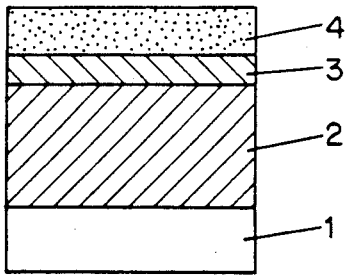
FIGS. 1(*a*) and 1(*b*) are schematic sectional views of the structures of embodiments of a photoreceptor according to the present invention.
Figure 1B:
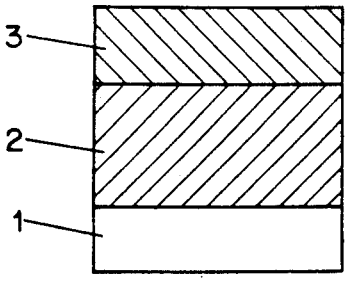

FIGS. 1(*a*) and 1(*b*) schematically show the sectional structures of respective embodiments of a function separation type photoreceptor according to the present invention. In FIG. 1(*a*), on a conductive substrate 1 a CTL 2 for transporting charges is provided, and a CGL 3 for generating hole-electron pairs by light irradiation is laminated on the CTL 2. Further, the surface of the CTL 3 is covered with an overcoat layer 4 (hereinunder referred to as "OCL") for enhancing the environmental resistance and printing durability. In FIG. 1(*b*), the OCL 4 is not provided.

EXAMPLE

In an embodiment of the present invention, an aluminum cylindrical substrate, 242 mm in diameter and 460 mm in length, is inserted in a high vacuum deposition apparatus. An evaporating material is obtained by adding $WO_2$ to an Se-As alloy composed of 1 atomic % of As and the balance Se in various mixing ratios. The evaporating material is accommodated in an evaporation source and evaporated by resistance heating or an electron beam so as to form the CTL 2 of 60 μm thick on the substrate. Thereafter, the CGL 3 of an Se-Te alloy containing 30 atomic % of Te and the OCL 4 of $As_2Se_3$ are subsequently laminated to a thickness of 0.5 μm and 1 μm, respectively thick by flash evaporation, co-evaporation or evaporation using a resistance heating evaporation source.

Figure 2:
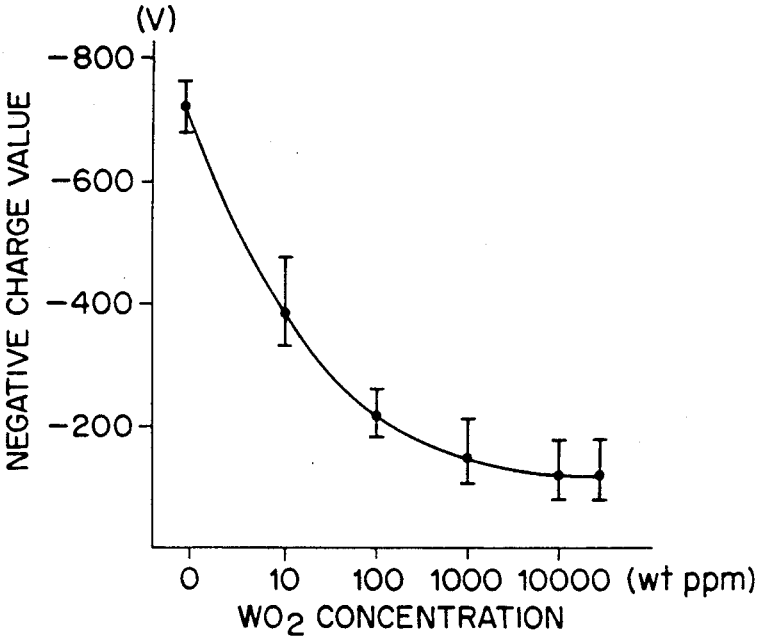
FIG. 2 shows the relationship between the negative charge value and the concentration of $WO_2$ added in the embodiment of a photoreceptor having a CTL of an Se-Te alloy with $WO_2$ added thereto and provided with an OCL.
Figure 3:
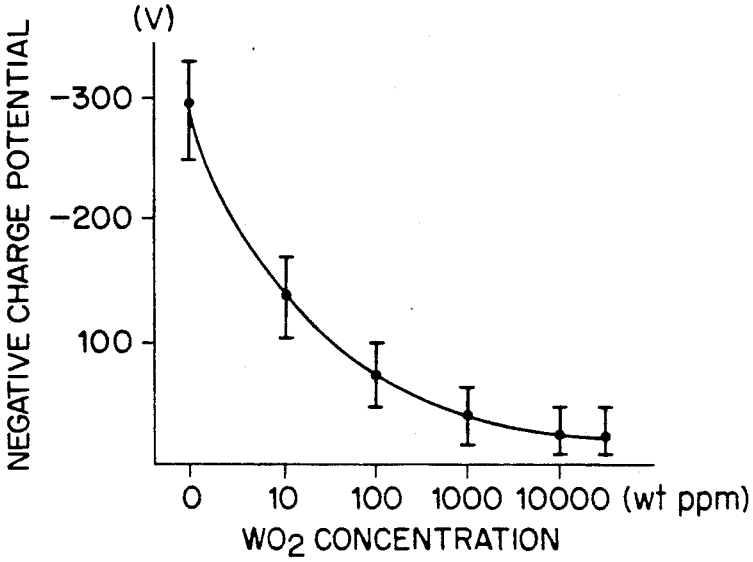
FIG. 3 shows the relationship between the negative charge value and the concentration of $WO_2$ added in the embodiment of a photoreceptor having the same CTL as in FIG. 2 but not provided with an OCL.

FIG. 2 shows the results of the examination of the dependence of the negative charge value of the photoreceptor having the structure shown in FIG. 1(*a*) on the concentration of $WO_2$ added in the CTL. Negative corona discharge was carried out under the condition that the flowing current in the case of providing only the substrate was 300 μm and the negative charge value was measured when photoreceptor rotating at a rate of 60 rpm came to the position at an angle of 70° from an electrifier. FIG. 3 shows the dependence of the negative charge value of the photoreceptor having the structure shown in FIG. 1(*b*) on the concentration of $WO_2$ added in the CTL measured in the same way as in the case of FIG. 2. In the embodiment shown in FIG. 1(*b*), the CTL is provided in the same way as in the embodiment shown in FIG. 1(*a*) and the CGL of Se-Te alloy is formed to a thickness of 2 μm on the CTL.

As is clear from FIGS. 2 and 3, the negative charge value begins to rapidly lower when the concentration of $WO_2$ added exceeds 10 wt. ppm, at several thousand wt. ppm the negative charge value shows the tendency of saturation, and at 10,000 wt. ppm it is substantially saturated. The same results were obtained when the As composition of the base material of the CTL, namely, the Se-As alloy was varied in the range of 0.01 to 5 atomic %. The same results were also obtained when any of $WO_3$, $MnO_4$, $H_3PO_3$, $H_2SO_3$ and $HAsO_2$ was molecular doped in the range of 10 wt. ppm to 5 wt. % in place of $WO_2$.

Furthermore, the same results were also obtained when 10 wt. ppm to 5 wt. % of any $WO_2$, $WO_3$, $MnO_4$, $H_3PO_3$, $H_2SO_3$ and $HAsO_2$ was molecular doped to a material obtained by adding 10 to 2,500 wt. ppm of a halogen, preferably, Cl or I to an Se-As alloy containing 0.01 to 5 atomic % of As, an Se-As alloy containing 15 to 45 atomic % of As, a material obtained by adding 10 to 2,500 wt. ppm of a halogen to an Se-As alloy containing 15 to 45 atomic % of As, pure Se, an Se-Te alloy containing not more than 10 atomic % of Te, or a material obtained by adding 10 to 2,500 wt. ppm of a halogen to an Se-Te alloy containing not more than 10 atomic % of Te as the CTL base material.

Figure 4:
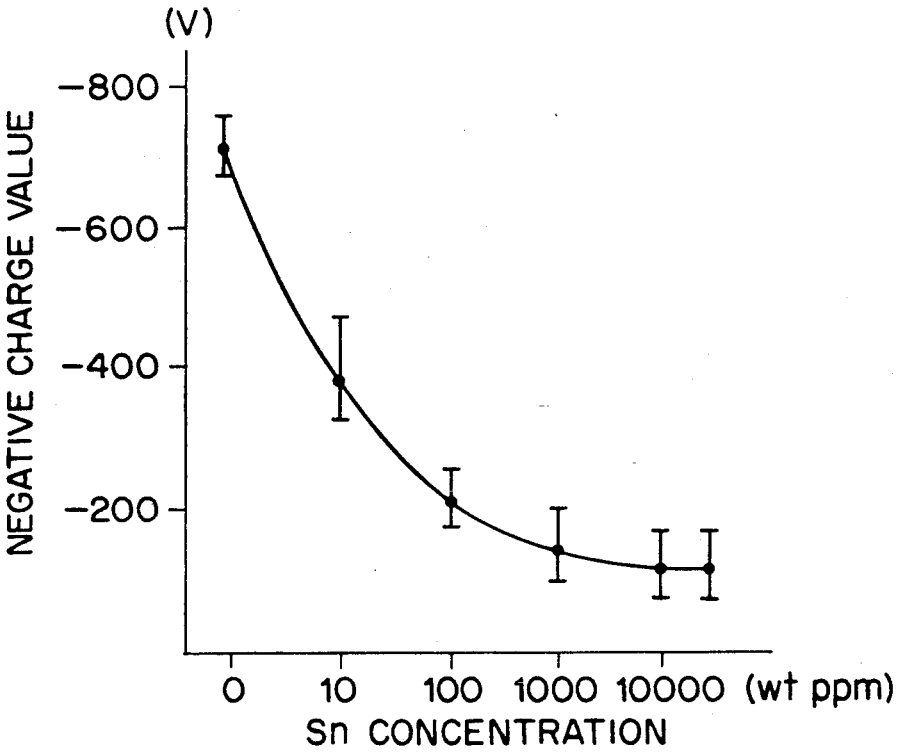
FIGS. 4 to 7 show the relationship between the negative charge value and the concentration of Sn or I added in the respective embodiments of a photoreceptor, wherein the embodiment in FIG. 4 has a CTL of $As_2Se_3$ with Sn added thereto and is provided with an OCL; the embodiment in FIG. 5 has the same CTL as in FIG. 4 but is not provided with an OCL; the embodiment in FIG. 6 has a CTL of an Se-Te alloy containing 5 atomic % of Te with I added thereto and is provided with an OCL; and the embodiment in FIG. 7 has the same CTL as in FIG. 6 but is not provided with an OCL.
Figure 5:
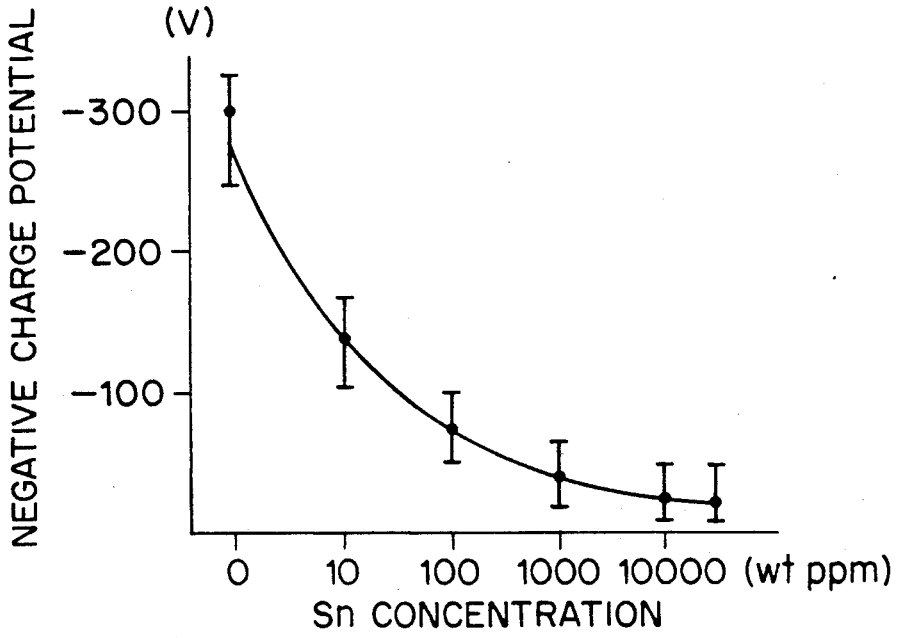

FIGS. 4 and 5 show the dependence of negative charge value on the Sn concentration in the CTL of photoreceptors having a CTL of 60 μm thick provided by depositing a material obtained by doping Sn onto As in various mixing ratios. The photoreceptor in the case of FIG. 4 has the structure shown in FIG. 1(*a*) and an Se-Te alloy containing 30 atomic % of Te was deposited as a CGL to a thickness of 0.5 μm, and As was deposited as an OCL to a thickness of 1 μm. The photoreceptors in the case of FIG. 5 have the structure shown in FIG. 1(*b*), and a CGL of As is formed on the CTL to a thickness of 2 μm. As is clear from FIGS. 4 and 5, the negative charge value begins to rapidly lower when the concentration of Sn added exceeds 10 atm ppm, at several thousand atm ppm the negative charge value shows the tendency of saturation, and at 1 atomic % it is substantially saturated. The same results were obtained when a material obtained by varying the As concentration in the range of 15 to 45 atomic % is used in place of the base material $As_2Se_3$ of the CTL. The same results were also obtained when any of Co, Pb, Fe, Cu, Hg, Ag and Ce was doped in the range of 10 atm ppm to 5 atomic % in place of Sn.

Furthermore, the same results were also obtained when 10 atm ppm to 5 atomic % of any of Sn, Pb, Fe, Cu, Hg and Ce was doped to a material obtained by adding 10 to 2,500 wt. ppm of a halogen, preferably, Cl or I to an Se-As alloy containing 15 to 45 atomic % of As, an Se-As alloy containing 0.01 to 5 atomic % of As, a material obtained by adding 10 to 2,500 wt. ppm of a halogen to an Se-As alloy containing 0.01 to 5 atomic % of As, pure Se, an Se-Te alloy containing not more than 10 atomic % of Te, or a material obtained by adding 10 to 2,500 wt. ppm of a halogen to an Se-Te alloy containing not more than 10 atomic % of Te as the CTL base material.

Figure 6:
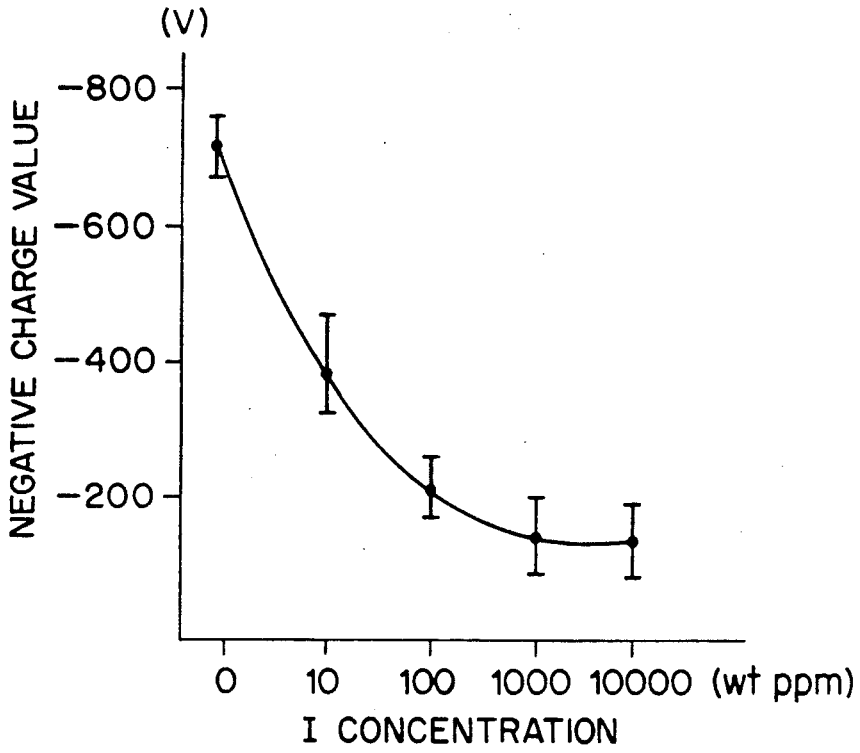
Figure 7:
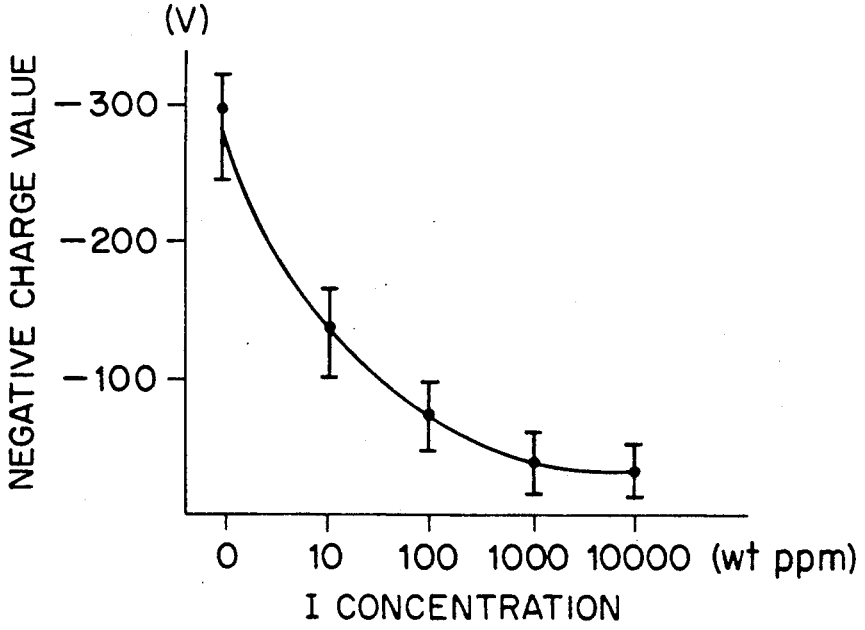

FIGS. 6 and 7 show the dependence of negative charge value on the I concentration in the CTL of photoreceptors having a CTL of 60 μm thick provided by depositing a material obtained by doping iodine onto an Se-Te alloy containing 5 atomic % of Te in various mixing ratios. The photoreceptor in the case of FIG. 6 has the structure shown in FIG. 1(*a*) and an Se-Te alloy containing 30 atomic % of Te was deposited as a CGL to a thickness of 0.5 μm, and $As_2Se_3$ was deposited as an OCL to a thickness of 1 μm. The photoreceptors in the case of FIG. 7 have the structure shown in FIG. 1(*b*), and a CGL of As is formed on the CTL to a thickness of 2 μm. As is clear from FIGS. 6 and 7, the negative charge value begins to rapidly lower when the concentration of Sn added exceeds 10 wt. ppm, at 1,000 wt. ppm the negative charge value shows the tendency of saturation, and at 2,000 wt. ppm it is substantially saturated. The same results were obtained when pure Se or an Se-Te alloy containing not more than 10 atomic % of Te was used as the CTL base material in place of an Se-Te alloy containing 5 atomic % of Te. The same results were also obtained when Cl was used in place of I. When other halogen elements were added to the Se-Te alloy in the range of 10 to 2,500 wt. ppm, the negative charge value reducing effect was also obtained.

Furthermore, the same results were also obtained when 10 to 2,500 wt. ppm of a halogen, preferably, Cl or I was added to an Se-As alloy containing 0.01 to 5 atomic % of As or an Se-As alloy containing 15 to 45 atomic % of As, an Se-As alloy containing 0.01 to 5 atomic % of As as the CTL base material.

According to the present invention, it is possible to accelerate the movement of the holes injected from the substrate to the surface of the photosensitive layer by adding impurities which enhance the hole mobility to the CTL consisting of an Se alloy, thereby rapidly attenuating the negative charge to 20% or less in the same process. Thus, an electrophotographic photoreceptor which is capable of forming an image having a good concentration uniformity with a small density difference between sheets was obtained.

I claim:

1. An electrophotographic photoreceptor comprising a charge transportation layer comprising a photosensitive material selected from the group consisting of amorphous selenium and selenium alloy containing a hole mobility enhancing material selected from the group consisting of tungsten dioxide ($WO_2$), tungsten trioxide ($WO_3$), manganese tetraoxide ($MnO_4$), phosphorous acid ($H_3PO_4$), sulfurous acid ($H_2SO_3$) and arsenous anhydride ($HAsO_2$) in an amount effective to rapidly attenuate negative charge and comprising a charge generation layer selected from the group consisting of amorphous selenium and selenium alloy.

2. An electrophotographic photoreceptor comprising a charge transportation layer comprising a photosensitive material selected from the group consisting of amorphous selenium and selenium alloy containing a hole mobility enhancing material selected from the group consisting of cobalt (Co), iron (Fe), copper (Cu), mercury (Hg) and silver (Ag) in an amount effective to rapidly attenuate negative charge, and comprising a charge generation layer selected from the group consisting of amorphous selenium and selenium alloy.

3. The electrophotographic photoreceptor according to claim 1, further comprising a halogen element as an additional hole mobility enhancing material.

4. The electrophotographic photoreceptor according to claim 1 or 2 in which the hole mobility enhancing material concentration is 10 wt. ppm to 5 wt. percent.

5. The electrophotographic photoreceptor according to claim 3 in which the halogen hole mobility enhancing material concentration is 10 to 2,5000 wt. parts per million.

6. The electrophotographic photoreceptor according to claim 1 in which the hole mobility enhancing material is tungsten dioxide ($WO_2$).

7. The electrophotographic photoreceptor according to claim 3 in which the halogen hole mobility enhancing material is iodine (I) or chlorine (Cl).

8. The electrophotographic photoreceptor according to claim 1 in which the hole mobility enhancing material is tungsten dioxide ($WO_2$).

* * * * *

UNITED STATES PATENT AND TRADEMARK OFFICE

CERTIFICATE OF CORRECTION

PATENT NO. : 5,085,959

DATED : February 4, 1992

INVENTOR(S) : Kazuyuki Urabe

It is certified that error appears in the above-identified patent and that said Letters Patent is hereby corrected as shown below:

Title page, Item 75, "Urabe Kazuyuk" should read --Kazuyuki Urabe"--;
Item (19) should read --Urabe--.
Title page, lines 5-6 of ABSTRACT, "emboidment" should read --embodiment--;

Column 3, line 66, "As" should read --$As_2Se_3$--;

Column 4, line 2, "As" should read --$As_2Se_3$--;

Column 4, line 5, "As" should read --$As_2Se_3$--;

Column 4, line 42, "As" should read --$As_2Se_3$--.

Signed and Sealed this

Sixth Day of July, 1993

Attest:

Michael K. Kirk

MICHAEL K. KIRK

Attesting Officer

Acting Commissioner of Patents and Trademarks